US006147476A

United States Patent [19]

Rockenbach et al.

[11] Patent Number: 6,147,476

[45] Date of Patent: Nov. 14, 2000

[54] TWO QUADRANT MAGAMP REGULATOR CONTROL CIRCUIT WITH FAST DYNAMIC RESPONSE AND FULL HOLDOFF CAPABILITY

[75] Inventors: Alan R. Rockenbach, Chalfont; Aaron Anton, St. Davids; Dominick F. Travaglini, Doylestown, all of Pa.

[73] Assignee: Deltron, Inc., North Wales, Pa.

[21] Appl. No.: 09/255,898

[22] Filed: Feb. 23, 1999

[51] Int. Cl.[7] ..... G05F 1/63

[52] U.S. Cl. ..... 323/254; 323/263; 323/93; 363/93

[58] Field of Search ..... 323/249, 251, 323/254, 259, 261, 263; 363/91, 93

[56] References Cited

U.S. PATENT DOCUMENTS 4,353,113 10/1982 Billings ..... 323/249
4,375,077 2/1983 Williams ..... 323/251
4,447,866 5/1984 Reeves ..... 363/93
4,626,976 12/1986 Abe et al. ..... 363/91
4,811,187 3/1989 Nakajima et al. ..... 363/91
4,930,063 5/1990 Henze et al. ..... 323/261
5,521,808 5/1996 Marusik et al. ..... 363/91
5,612,862 3/1997 Marusik et al. ..... 363/93

*Primary Examiner*—Jeffrey Sterrett
*Attorney, Agent, or Firm*—Volpe and Koenig, P.C.

[57] ABSTRACT

A magamp circuit including a saturable reactor for regulating the output energy delivered to a load and having a protective circuit for restricting energy flow to the load in the event of occurrence of a short-circuit at the load. Output energy fluctuations are reduced through the use of a non-linear feed forward response circuit. A circuit which compensates for an unwanted voltage reset applied to the saturable reactor due to reverse current leakage or reverse recovery energy of a protective diode is also provided.

17 Claims, 3 Drawing Sheets

TWO QUADRANT MAGAMP REGULATOR CONTROL CIRCUIT WITH FAST DYNAMIC RESPONSE AND FULL HOLDOFF CAPABILITY

FIELD OF THE INVENTION

The present invention relates to protective circuitry for a magamp regulator control circuit and, more particularly, to protective circuitry for respectively restricting the flow of output energy to a load in the case of a short circuit; reducing output voltage fluctuations through the employment of a circuit which yields a nonlinear, feed forward response; and providing a circuit which compensates for unwanted voltage reset applied to a saturable reactor which results from power diode turn-off reverse recovery energy or reverse current leakage.

BACKGROUND OF THE INVENTION

FIG. 1 shows a conventional magamp regulator circuit 10 having a transformer secondary winding 12 forming part of a transformer whose primary winding is not shown for purposes of simplicity. The magamp 10 delivers a pulse-width modulated output signal through a low pass filter consisting of L2 and C1 to output load R5. The output level of the signal is maintained at a substantially constant level by controlling the "duty cycle" (i.e., the time interval of each pulse) through feedback control means including feedback amplifier 14 which monitors the output level of the signal across load R5, controlling the relative conduction and nonconduction of a transistor Q1 forming part of a control circuit, the feedback signal being applied to the base electrode thereof.

The feedback amplifier constantly monitors the output voltage and adjusts the bias on Q1's base electrode such that the output voltage R5 is maintained constant. If the output voltage rises above the correct value, the feedback circuit will increase the current through Q1, which will reset L1 to a greater extent, thus decreasing the magamp duty cycle and lowering the output voltage applied to R5. If the output voltage decreases below the correct value, the feedback circuit will decrease the current through Q1, thereby allowing the magamp duty cycle to increase and raising the output voltage applied to R5. Control is maintained on a cycle by cycle basis.

Diode D1 prevents reverse current flow toward the magnetic amplifier. Diode D2 provides a current path for filter inductor L2 and output load R5 when D1 and magamp L1 are not conducting.

The conventional magamp control circuit of FIG. 1 has a number of problems, some of the significant ones being:

In the event of a short circuit condition across the load, the magamp circuit of FIG. 1 lacks the capability of restricting the output to load R5 due to a lack of sufficient internal bias provided to the transistor Q1 of the control circuit. For example, assuming a short circuit condition across load R5, the feedback amplifier circuit 12 holds the base of transistor Q1 at ground potential. In order for the control circuit to be functional, the emitter of Q1 must be maintained a 0.60 volts above ground potential. With the output at 0.60 volts, an uncontrolled amount of current can flow through the output. Previous circuits capable of short circuit current limiting required either an external bias or a far more elaborate circuit implementation;

The conventional magamp regulator, due to inherent circuit architecture responds too slowly to dynamic loading which results in undesirable fluctuations in output voltage;

The present magamp topology provides no means for compensating for an unwanted voltage reset applied to the saturable reactor as a result of power diode turn-off reverse recovery energy or reverse current leakage across protective diode D1. The best diodes presently available have a reverse recovery time that extends from 25 nsecs under ideal conditions to 200 nsecs and beyond. High temperatures exacerbate the problem, making it even more cumbersome to resolve. During the reverse recovery time of rectifier diode D1, the summation of the reverse transformer voltage plus the output voltage is applied to the magamp (inductor L1). This applied voltage via the effective shorting of diode D1 (reverse recovery time) results in an unwanted volt-second reset of the saturable reactor that limits the maximum available duty cycle of the voltage control circuit. A reduction in the duty cycle causes the output to drop in voltage which results in deregulation of the output. In circuits that combine high voltage with high current outputs, the parasitic reset may be sufficient to prevent the circuit from operating normally.

BRIEF DESCRIPTION OF THE INVENTION

The present invention is characterized by providing protective circuits for resolving the above problems encountered in the conventional magamp regulator control circuit.

More specifically:

The magamp regulator control circuit is provided with a differential amplifier circuit and an additional winding forming part of the magamp (saturable reactor) which develops a full volt-second hold-off capability enabling the output to go to zero volts to reduce the amplitude of the short circuit current thereby preventing an uncontrolled amount of current flow through the output.

In order to solve the second problem of slow response to dynamic loading, a high speed transient response circuit is provided to control the differential amplifier, enabling the emitter of one of the control transistors of the differential amplifier to go from one end of its operating range to the other with a variation of less than 200 millivolts at the emitter due to the circuit which holds the base at a constant voltage.

The third problem set forth hereinabove, namely, the reverse current leakage of the protective diode, is resolved by the present invention. By utilizing an additional winding as part of the saturable reactor, unwanted reset action due to the recovery current from the protective diode is compensated for, enabling the differential amplifier to control the duty cycle and maintain output voltage regulation.

OBJECTS OF THE INVENTION

It is therefore one object to provide a magamp regulator circuit with a simple protective circuit for restricting the output current to a load by providing an internal bias and thereby prevent a short circuit from damaging or destroying the magamp regulator circuit.

Still another object of the present invention is to provide a magamp regulator circuit with a control circuit of simple design and which provides a magamp circuit with a nonlinear-feed-forward response which vastly reduces output fluctuations which may otherwise occur under input and output dynamics.

Still another object of the present invention is to provide a magamp regulator circuit having a novel compensating circuit for protecting against unwanted voltage reset.

BRIEF DESCRIPTION OF THE FIGURES

The above, as well as other objects of the present invention, will become apparent when reading the enclosed description and drawing in which.

DETAILED DESCRIPTION OF THE INVENTION

Figure 1:
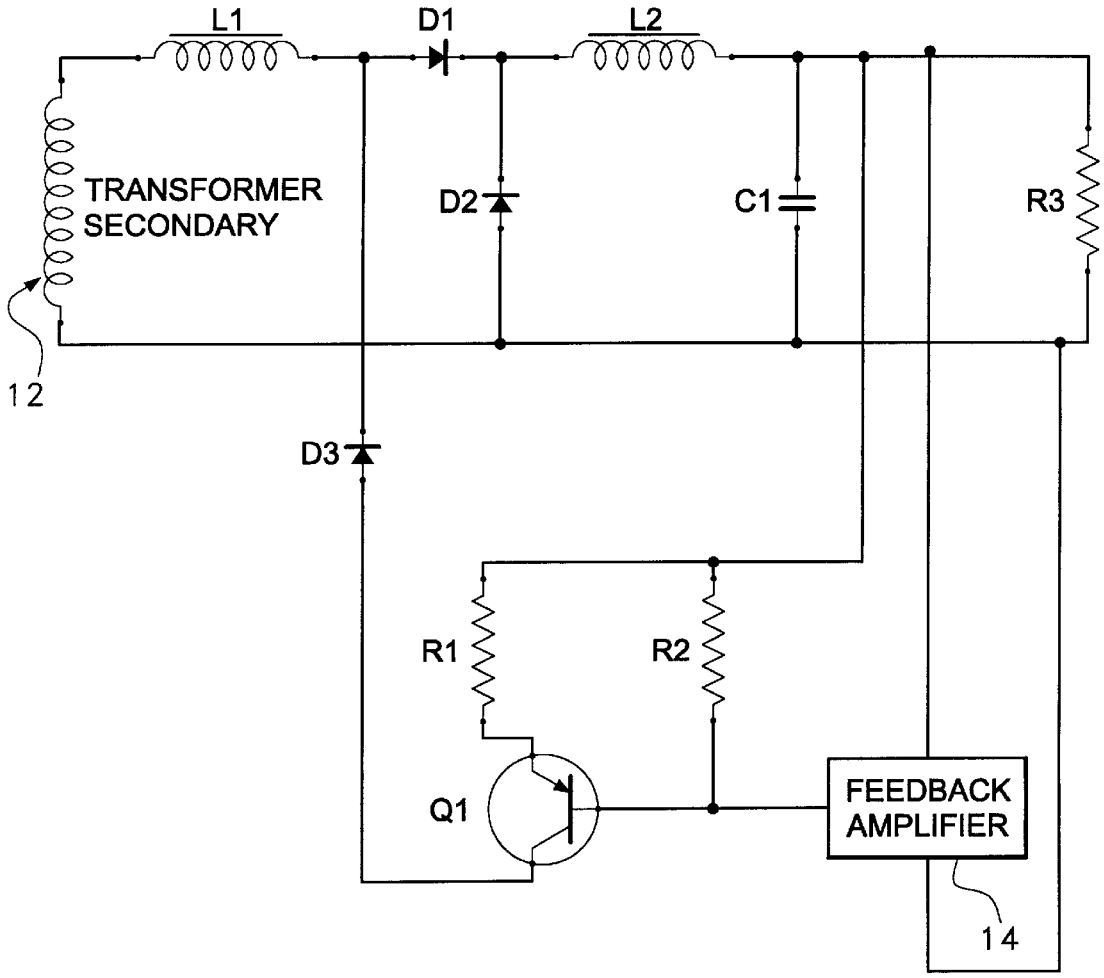
Fig. 1 (Prior Art)
FIG. 1 shows a conventional magamp control circuit.
Figure 2:
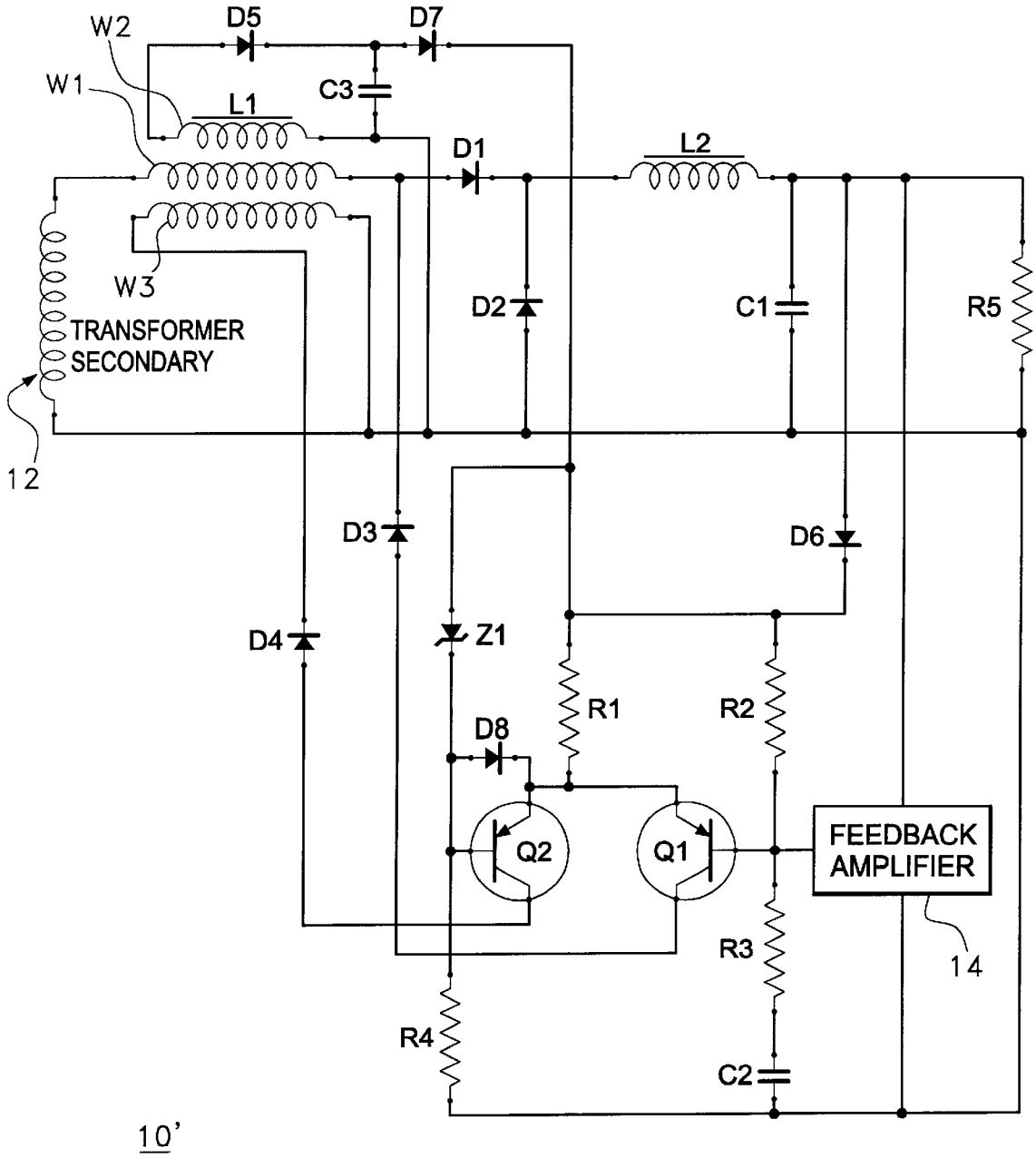
FIG. 2 shows a novel magamp control circuit of the present invention utilizing the novel protective and corrective circuitry achieving the above-mentioned objects.

FIG. 2 is a schematic of the magamp control circuit of the present invention in which like elements as between FIG. 2 and FIG. 1 are designated by like numerals. Since the like elements of FIG. 2 have the same functions as the like elements of FIG. 1, the following description will be limited, for purposes of brevity, to the novel circuit components and their mode of operation.

The magamp control circuit 10' of FIG. 2 comprises a differential amplifier formed of transistors Q1 and Q2.

Circuit components D5, C3, winding W2 of saturable reactor L1, D7, and D6 comprise a low level bias circuit which is operational only when the saturable reactor is in the short circuit protection mode.

Transformer action between winding W1 and W2 of saturable reactor L1 forward biases diode D5, charging capacitor C3 to a voltage of the order 3 to 4 volts, during normal operation. The turns ratio as between windings WI and W2 is chosen so that the voltage developed by capacitor C3 during normal operation is well below the output voltage across load R5, causing diode D7 to be back biased. During normal operation, power for the reset circuit is drawn through diode D6.

Assuming a short-circuit develops across the load R5, the output voltage across R5 tends toward 0 volts, at some point causing diode D6 to become reversed biased, allowing diode D7 to conduct in the forward direction. The additional voltage is supplied from capacitor C3 under these circumstances allowing saturable reactor L1 to be reset with more volts-seconds than it will see in the forward direction, thereby allowing the output voltage to be decreased to 0 volts thereby providing a well controlled current output.

Comparing this with the conventional circuit shown in FIG. 1, when a short-circuit develops across load R5, the emitter of transistor Q1 drops to 0 volts resulting in total loss of control of the output duty cycle. By providing a suitable voltage level at the emitter of Q1, control is maintained even in the event of a short-circuit across load R5.

The circuit of FIG. 2, in order to resolve the aforementioned slow response to input and output dynamics, utilizes a high-speed transient response circuit comprised of capacitor C2 and resistor R3 which act to hold the base of Q1 at a voltage determined by the control circuit 10'. In the event of a load transient at the output, the emitter voltage Q1 will vary. By holding its base electrode at a constant voltage, a variation of less than 250 millivolts at the emitter will cause Q1 to go from one end of its operating range to the other which, in turn, will cause the saturable reactor to swing its duty cycle over its full range within one switching cycle, thereby providing a quick response to the transient.

Figure 3:
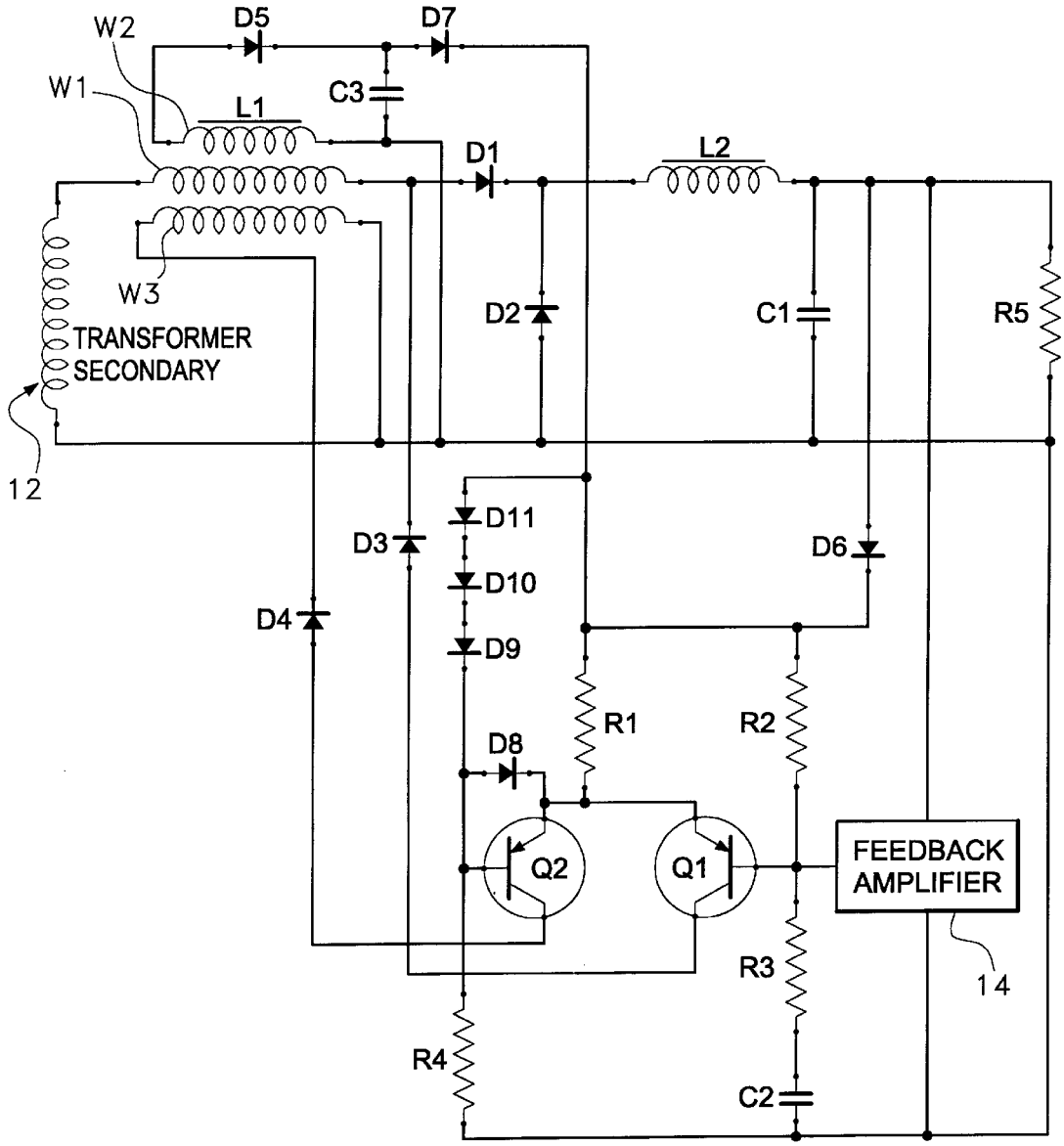
FIG. 3 shows an alternative embodiment of the magamp control circuit of FIG. 2.

The components R1, R4, Q1, Q2, Z1, D4, and winding W3 of saturable reactor L1 provide a two quadrant control capability enabling the control circuit 10' to provide both forward and reverse volt-seconds to the saturable reactor L1. Transistors Q1 and Q2 form a simple differential amplifier. In normal operation, transistor Q2 is back biased by zener diode Z1 or other suitable voltage offset means, such as a string of diodes, such as diodes D9–D11, shown in FIG. 3. Feedback amplifier 14 drives transistor Q1 through the base electrode, which provides reset to the saturable reactor through diode D3, which action controls the reactor's duty cycle. Under conditions of high load and high temperature, reverse recovery current flowing through diode D1 may cause the saturable reactor L1 to reset more than is called for by the control circuit. In such event, the control circuit will allow the base of Q1 to go high, cutting off Q1 and causing Q2 to conduct. Current from Q2 flows through diode D4 to winding W3 on the saturable reactor in the correct direction to oppose the unwanted reset from diode D1. Under these conditions, the dynamic balance between the unwanted reset from D1 and the set current from Q2 control the duty cycle and maintain output voltage regulation, even in the event of a diode, utilized as diode D1, which has an undesirable reverse recovery current.

A latitude of modification, change and substitution is intended in the foregoing disclosure, and in some instances, some features of the invention will be employed without a corresponding use of other features. Accordingly, it is appropriate that claims of the invention, when presented, be construed broadly and in a manner consistent with the spirit and scope of the invention herein described.

What is claimed is:

1. A circuit for maintaining an output signal at a given level comprising:

an input receiving a signal of a given frequency;

an output a saturable reactor coupled between said input and output and having a variable impedance for controlling the level of the signal delivered to a load coupled to the output;

a differential amplifier for controlling the impedance of said saturable reactor; and a feedback circuit monitoring a level of an output signal across the load for applying a control signal to said differential amplifier;

said differential amplifier having a first output coupled to the saturable reactor for increasing the impedance of the saturable reactor when the feedback circuit determines that the output level is greater than a threshold and a second output coupled to the saturable reactor for reducing the impedance of the saturable reactor when the output level is below said threshold.

2. The circuit of claim 1, wherein said first output of the differential amplifier is coupled to the saturable reactor in a direction to increase impedance of the saturable reactor when a current is present at said first output.

3. The circuit of claim 2 wherein said saturable reactor has a main winding and further including a diode coupled between said first output and said main winding and being polarized to enable unilateral flow of current to said main winding.

4. The circuit of claim 1 wherein said saturable reactor has a main winding and a secondary winding, said second output of the differential amplifier is coupled to said second winding in a direction to reduce impedance of said saturable reactor in the presence of current at said second output.

5. The circuit of claim 4 further including a diode coupled between said second output and said second winding and being polarized to enable unilateral flow of current to said second winding.

6. The circuit of claim 1 wherein said differential amplifier has a common input to one side of said load, and first and second inputs respectively coupled to said feedback circuit and to said one side of said load through an element providing a given voltage drop; and a bias circuit coupled between said saturable reactor and said differential amplifier for providing a bias voltage at the common input of said differential amplifier to assure continued control of output voltage level of said circuit even in the event of a short-circuit across said load.

7. The circuit of claim 6 further comprising a diode coupled between said common input and said one side of said load to couple the output level across said load to said common input.

8. The circuit of claim 7 further comprising an impedance element coupling said diode and said bias circuit to said common input to normally couple the output across said load to said common input and to couple a voltage of proper polarity to said bias circuit to said common input.

9. The circuit of claim 6 wherein said saturable reactor has a main winding and a secondary winding and said bias circuit further comprises:

a second diode and a capacitor coupled across said second winding to develop a voltage of proper polarity across said capacitor; and a third diode coupling the bias circuit to said common input.

10. The circuit of claim 9 wherein the voltage developed across the capacitor is sufficient to allow the circuit to apply sufficient reset to the saturable reactor to bring about zero duty cycle or full holdoff condition.

11. The circuit of claim 10 wherein the secondary winding has turns sufficient to develop said sufficient voltage.

12. The circuit of claim 9 wherein the voltage developed by said bias circuit may be whatever additional voltage is required to bring about full holdoff.

13. The circuit of claim 1 wherein said differential amplifier has a common input coupled to one side of said load, and first and second inputs respectively coupled to said feedback circuit and to one side of said load through an element providing a given voltage drop;

a bias circuit comprised of a series circuit of passive elements across said load;

said series circuit including a least a resistor and a capacitor, a terminal intermediate said resistor and said capacitor being coupled to said differential amplifier to provide a substantially fixed bias to said first input to assure proper control operation of said differential amplifier even in the even that a sudden, unwanted increase in the level of the output occurs the load, by enabling said common terminal to properly and effectively control operation of said differential amplifier.

14. The circuit of claim 13, wherein said series circuit includes a second resistor coupled between said first resistor and said capacitor, said terminal being between said first and second resistors;

said first resistor being coupled to one terminal of said load through a diode;

said second resistor and said capacitor being coupled between the first input of said differential amplifier and a remaining terminal of said load.

15. The circuit of claim 1 wherein said differential amplifier has a common input coupled to one side of said load, and first and second inputs respectively coupled to said feedback circuit and to said one side of said load through an element providing a given voltage drop;

means coupled between said saturable reactor and said differential amplifier for providing a bias voltage at the common input of said differential amplifier to assure continued control of output voltage level of said circuit even in the event of a short-circuit across said load; and said element for providing a given voltage drop also providing a voltage offset to apply a given bias level to said second input.

16. The circuit of claim 15 wherein said voltage offset means comprises a zener diode.

17. The circuit of claim 15 wherein said voltage offset means comprises a plurality of diodes.

* * * * *